US009230769B2

(12) United States Patent
Carpenter et al.

(10) Patent No.: US 9,230,769 B2
(45) Date of Patent: Jan. 5, 2016

(54) LIGHT SOURCE

(71) Applicant: Ceravision Limited, Milton Keynes (GB)

(72) Inventors: Paul Carpenter, Lower Boddington (GB); Andrew Simon Neate, Near Leighton Buzzard (GB); Tim Burnitt, Reading (GB)

(73) Assignee: Ceravision Limited

( * ) Notice: Subject to any disclaimer, the term of this patent is extended or adjusted under 35 U.S.C. 154(b) by 0 days.

(21) Appl. No.: 14/389,415

(22) PCT Filed: Mar. 28, 2013

(86) PCT No.: PCT/GB2013/000147

§ 371 (c)(1),
(2) Date: Sep. 30, 2014

(87) PCT Pub. No.: WO2013/153347

PCT Pub. Date: Oct. 17, 2013

(65) Prior Publication Data

US 2015/0097476 A1 Apr. 9, 2015

(30) Foreign Application Priority Data

Apr. 13, 2012 (GB) ..... 1206556.1

(51) Int. Cl.

| | |
|---|---|
| ***H01J 5/16*** | (2006.01) |
| ***H01J 11/00*** | (2012.01) |
| ***F21V 7/00*** | (2006.01) |

(Continued)

(52) U.S. Cl.

CPC . *H01J 5/16* (2013.01); *H01J 11/00* (2013.01); *H01J 61/025* (2013.01); *H01J 65/044* (2013.01); *F21V 7/00* (2013.01)

(58) Field of Classification Search

None

See application file for complete search history.

(56) References Cited

U.S. PATENT DOCUMENTS 4,498,029 A * 2/1985 Yoshizawa et al. ..... 315/39
4,504,768 A * 3/1985 Ury et al. ..... 315/248

(Continued)

FOREIGN PATENT DOCUMENTS

| | | | |
|---|---|---|---|
| EP | 2188829 | | 5/2010 |
| WO | 2011-020989 | * | 2/2011 |
| WO | WO 2011020989 | | 2/2011 |

OTHER PUBLICATIONS

J.R. Coaten and A.M. Marsden (Ed.): Lamps and Lighting (published 1997); Part III, Chapter 18.4, pp. 356-362.

*Primary Examiner* — Ashok Patel

(74) *Attorney, Agent, or Firm* — Jennifer Meredith, Esq.; Meredith & Keyhani, PLLC

(57) ABSTRACT

An LER LUWPL source luminaire having a magnetron heat conductingly mounted below a finned heat dissipater with a suspension eye. The magnetron is attached to a microwave transition and a lucent crucible. An imperforate cover extends down from the heat dissipater and is closed by a transparent screen, held by a molding. A generally square shaped molding supports a polished-sheet-metal reflector (having four triangular faces, pyramidally arranged, with a square base embodied by a rim supported on the top of the screen above the molding) extending back to the lucent crucible, with its reflective surfaces obliquely facing both the crucible and the screen for reflection of light from the crucible out of the luminaire via the screen. The faces converge to a virtual apex, on the central axis of the lucent crucible. This axis is coincident with the pyramid's normal axis from the apex to the center of the base.

14 Claims, 9 Drawing Sheets

(51) Int. Cl.

| | |
|---|---|
| ***F21V 7/20*** | (2006.01) |
| ***H01J 61/02*** | (2006.01) |
| ***H01J 65/04*** | (2006.01) |

(56) References Cited

U.S. PATENT DOCUMENTS

| | | | | |
|---|---|---|---|---|
| 5,816,694 | A * | 10/1998 | Ideker et al. | 362/348 |
| 6,323,601 | B1 * | 11/2001 | Klein et al. | 315/248 |
| 6,465,959 | B1 | 10/2002 | Tian | |
| 6,791,270 | B2 * | 9/2004 | Kim et al. | 315/39 |
| 2001/0038502 | A1 * | 11/2001 | Minissi et al. | 359/850 |
| 2003/0193299 | A1 * | 10/2003 | Choi et al. | 315/248 |
| 2010/0246189 | A1 * | 9/2010 | Heitmann | 362/297 |
| 2010/0302768 | A1 * | 12/2010 | Collins et al. | 362/217.05 |
| 2012/0081906 | A1 * | 4/2012 | Verfuerth et al. | 362/294 |

* cited by examiner

LIGHT SOURCE

The present invention relates to a light source.

We have developed technology for the production of light via plasma excitation in a LUcent Waveguide electromagnetic wave Plasma Light source. We refer to this technology as LUWPL technology.

We define a LUWPL source as having:

a fabrication of solid-dielectric, lucent material, having;

a closed void containing electro-magnetic wave, normally microwave, excitable material; and a Faraday cage:

delimiting a waveguide, being at least partially lucent, and normally at least partially transparent, for light emission from it, normally having a non-lucent closure and enclosing the fabrication;

provision for introducing plasma exciting electro-magnetic waves, normally microwaves, into the waveguide;

the arrangement being such that on introduction of electromagnetic waves, normally microwaves, of a determined frequency a plasma is established in the void and light is emitted via the Faraday cage.

In our so-called "LER" patent application No. EP2188829, there is described and claimed (as granted):

A light source to be powered by microwave energy, the source having:

a body having a sealed void therein, a microwave-enclosing Faraday cage surrounding the body, the body within the Faraday cage being a resonant waveguide, a fill in the void of material excitable by microwave energy to form a light emitting plasma therein, and an antenna arranged within the body for transmitting plasma-inducing, microwave energy to the fill, the antenna having:

a connection extending outside the body for coupling to a source of microwave energy;

wherein:

the body is a solid plasma crucible of material which is lucent for exit of light therefrom, and the Faraday cage is at least partially light transmitting for light exit from the plasma crucible, the arrangement being such that light from a plasma in the void can pass through the plasma crucible and radiate from it via the cage.

As used in Our LER Patent:

"lucent" means that the material, of the item which is described as lucent, is transparent or translucent—this meaning is also used in the present specification in respect of its invention;

"plasma crucible" means a closed body enclosing a plasma, the latter being in the void when the void's fill is excited by microwave energy from the antenna.

In our International patent application No PCT/GB2010/001518, we have described and claimed:

A luminaire having:

a plasma light source powered by High Frequency (HF) power;

a HF power supply having a physical structure, the light source and the HF-power-supply physical structure being connected together as an assembly;

a housing for the HF power supply, the said assembly and the housing being fastened together and the housing having:

an aperture through which the said assembly extends with cooling air flow clearance and a cooling air fan arranged at an opening in the housing for drawing air in (or out) for cooling of the HF power supply and passage out (or in) via the aperture and past the light source; and a reflector for at least substantially collimating light from the light source fastened to the housing at the aperture and the reflector having its own aperture through which the said assembly extends, with the light source arranged within the reflector.

This was drafted before we defined a LUWPL. We refer to this luminaire as "our First Luminaire". It was intended to include an LER LUWPL.

The reflector of our First Luminaire is circular in sectional plan. It throws a circular cylindrical pattern of light except that its LER antenna causes a perceptible shadow.

The object of the present invention is to provide a LUWPL source luminaire with an improved reflector.

According to the invention there is provided a Lucent Waveguide Plasma Light source luminaire comprising:

a light outlet, a LUWPL source and a reflector comprised of reflective surfaces obliquely facing both a fabrication of the LUWPL source and the light outlet from the luminaire, the reflective surfaces being arranged in the manner of a pyramid, with a closed void of the fabrication being at least substantially aligned with or intercepting the central axis of the pyramid.

As used herein:

"Pyramid" means "A solid figure with a polygonal base and triangular faces that meet at a common point or apex". Normally the triangular faces will be mutually identical and define by their sides opposite from the apex a base plane.

"Central axis of the pyramid" is the axis passing from the apex to the centre of the base.

Normally the closed void will be positioned at between 10% and 40% of the distance from the apex to the base and preferably between 15% and 30%. In the preferred embodiment the void is at approximately 20% of the distance.

Whilst in the preferred embodiment, the reflective surfaces, corresponding to the triangular faces, are planar; it is envisaged that they could be curved and in particular splaying out with a greater angle to the axis further from the apex.

In the preferred embodiment, the triangular faces are arranged at substantially 45° to the axis. Other angles, particularly between 40° and 50° can be used to spread or confine the light projection from the luminaire.

In the preferred embodiment, the polygonal base is a square, which is particularly convenient for an array of luminaires arranged on a square array illuminating an area which is extensive in two directions. Where the area is extensive in a single direction, albeit with transverse width, the polygonal base can be rectangular, with its longer dimension extending in the single direction in use.

Polygonal bases with three or five or more sides can be conceived of for illuminating unusually shaped areas.

It will be appreciated that use of pyramidally arranged reflective surfaces causes the projected light to be spread further in directions of the sides of the base than would be the case if the reflective surfaces were circular in plan.

In accordance with a particularly preferred feature, the antenna in an LER LUPWL luminaire of the invention is arranged at least substantially in a bisector plane of the two faces of the pyramid arrangement.

To help understanding of the invention, a specific embodiment thereof will now be described by way of example and with reference to the accompanying drawings, in which:

FIG. 8 is a slightly turned side view of the reflector, with its virtual apex drawn in.

Figure 1:
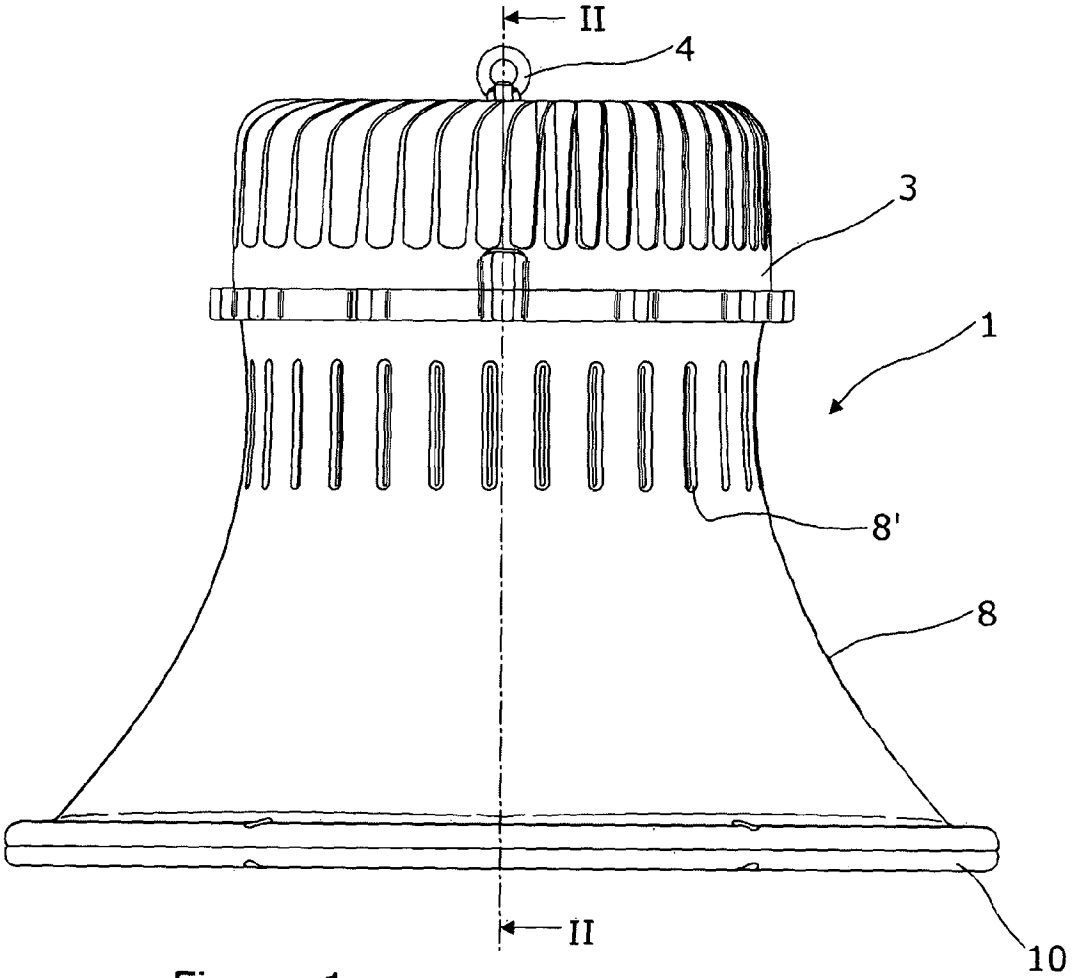
FIG. 1 is a side view of a LUWPL luminaire in accordance with the invention, the view being in the direction of the arrow I in FIG. 2.
Figure 2:
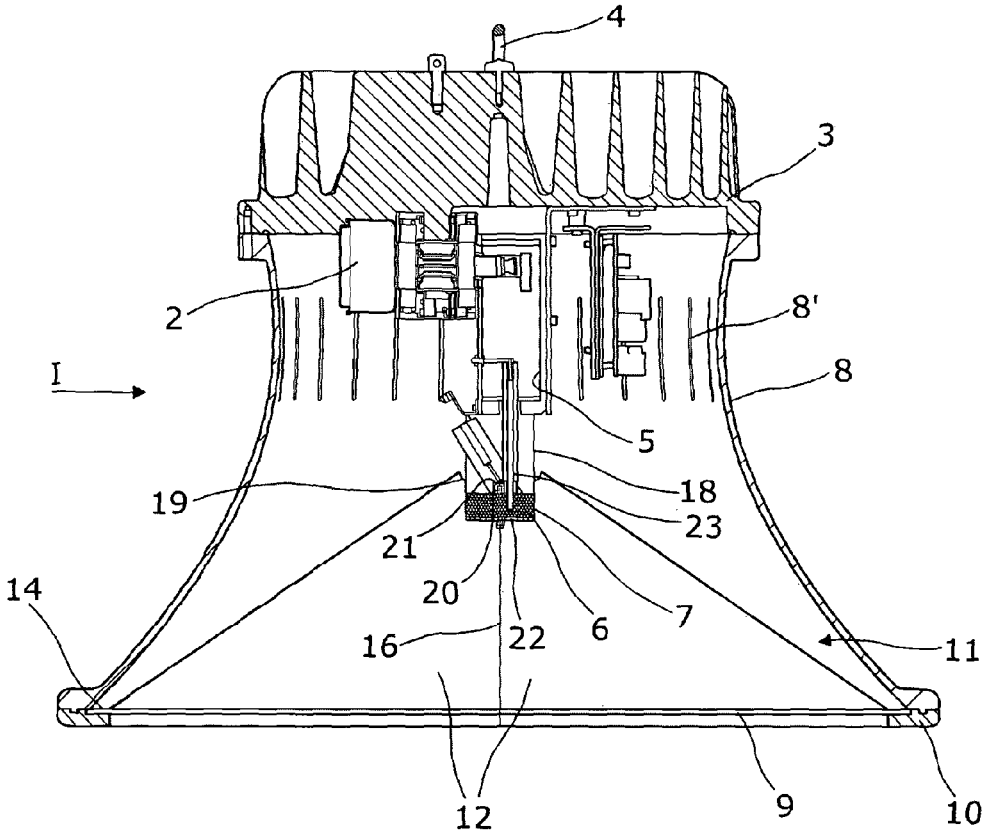
FIG. 2 is a central cross-sectional side view of the luminaire on the line II-II in FIG. 1.
Figure 3:
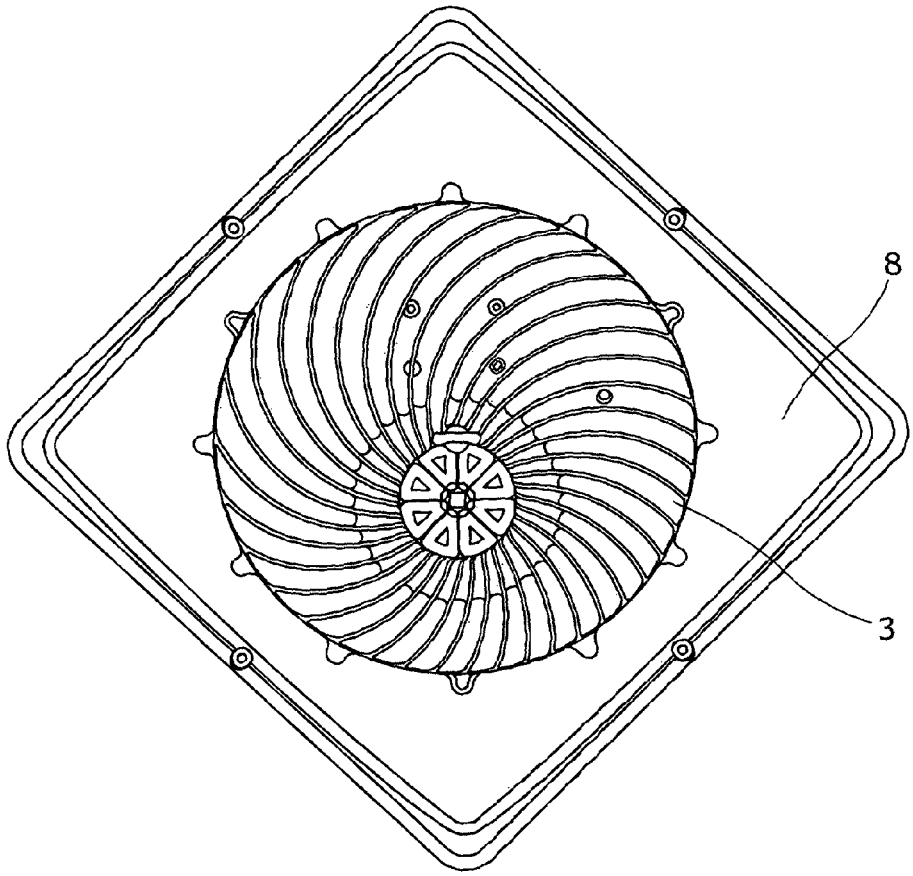
FIG. 3 is a plan view of the luminaire of FIG. 1.
Figure 4:
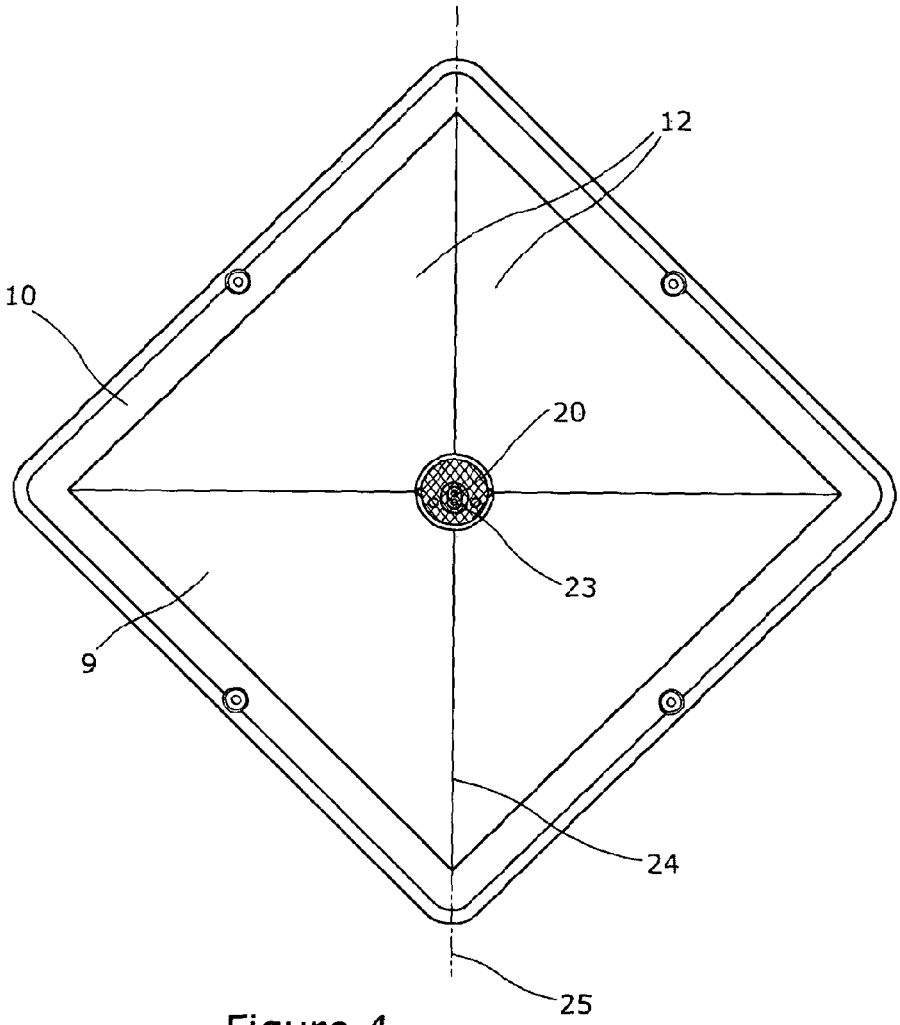
FIG. 4 is an underneath view of the luminaire of FIG. 1.
Figure 5:
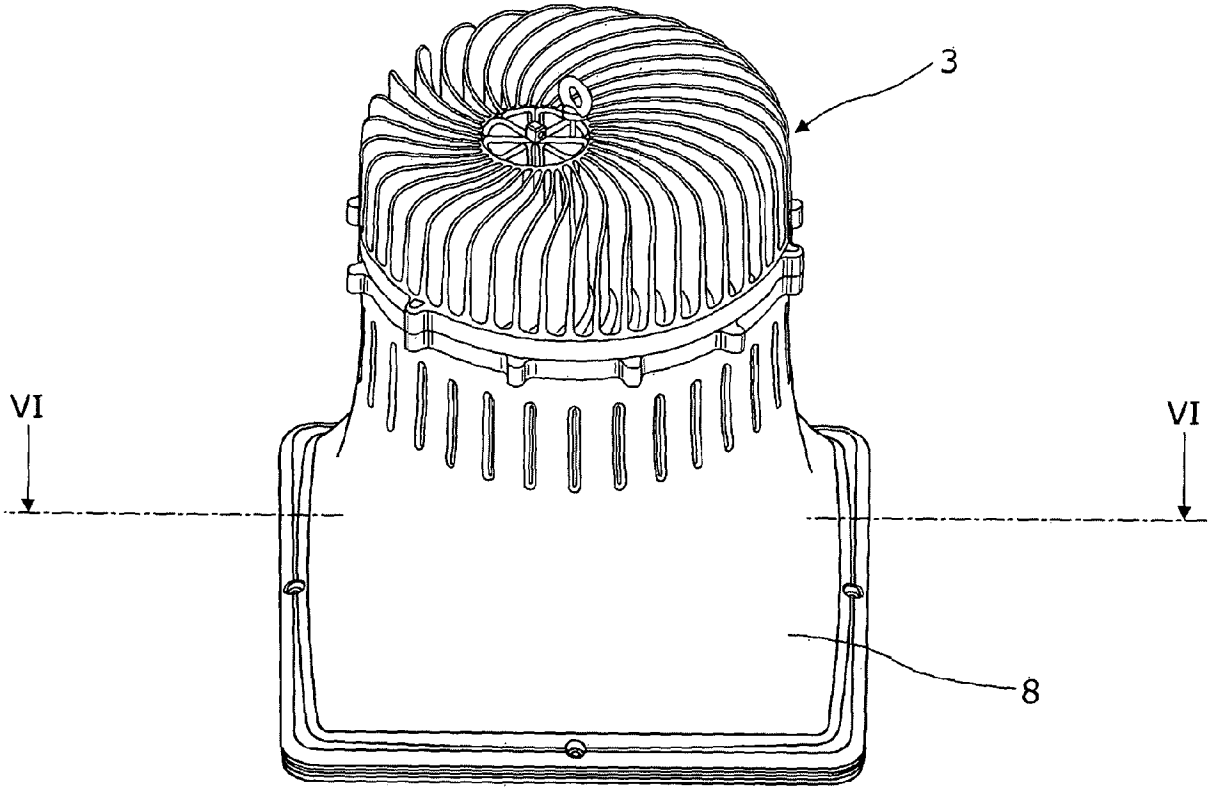
FIG. 5 is a perspective view of the luminaire.
Figure 6:
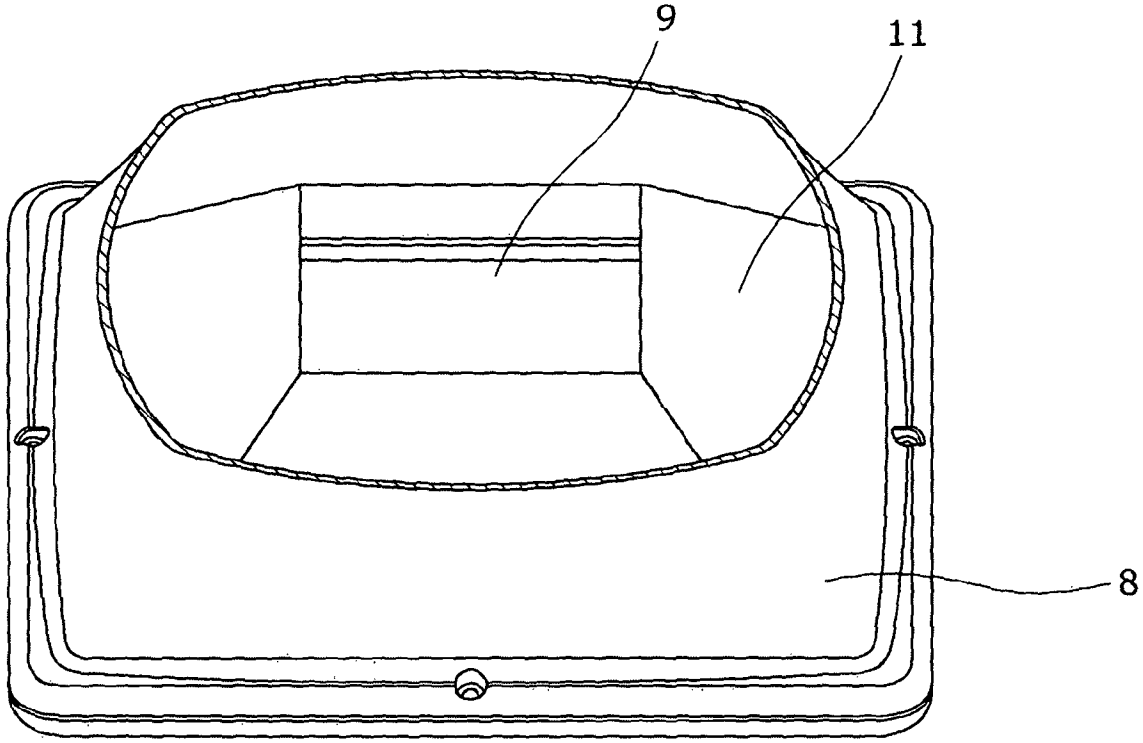
FIG. 6 is a corresponding cross-sectional perspective view of the reflector and lower part of the luminaire, the section being on the line VI-VI in FIG. 5.
Figure 7:
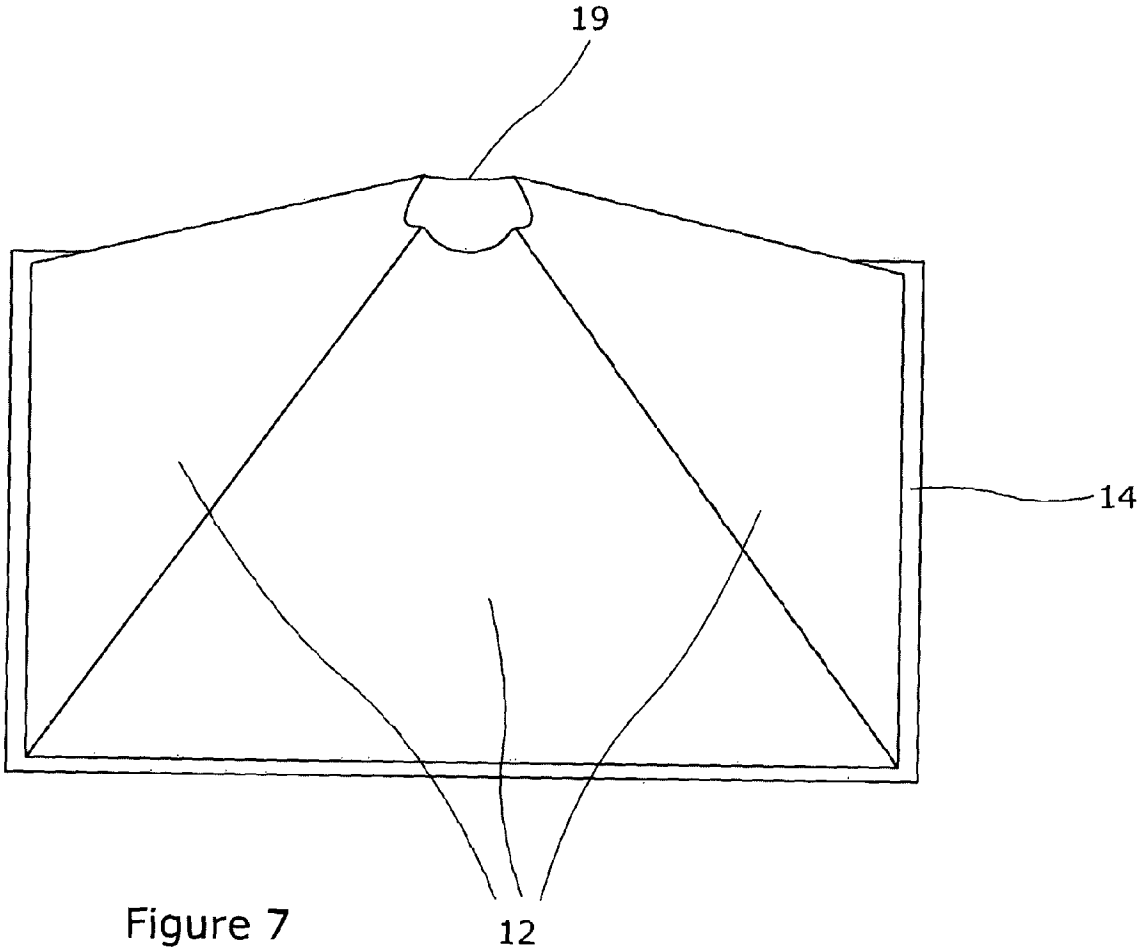
FIG. 7 is a corresponding view of the reflector only, shown in full.
Figure 8:
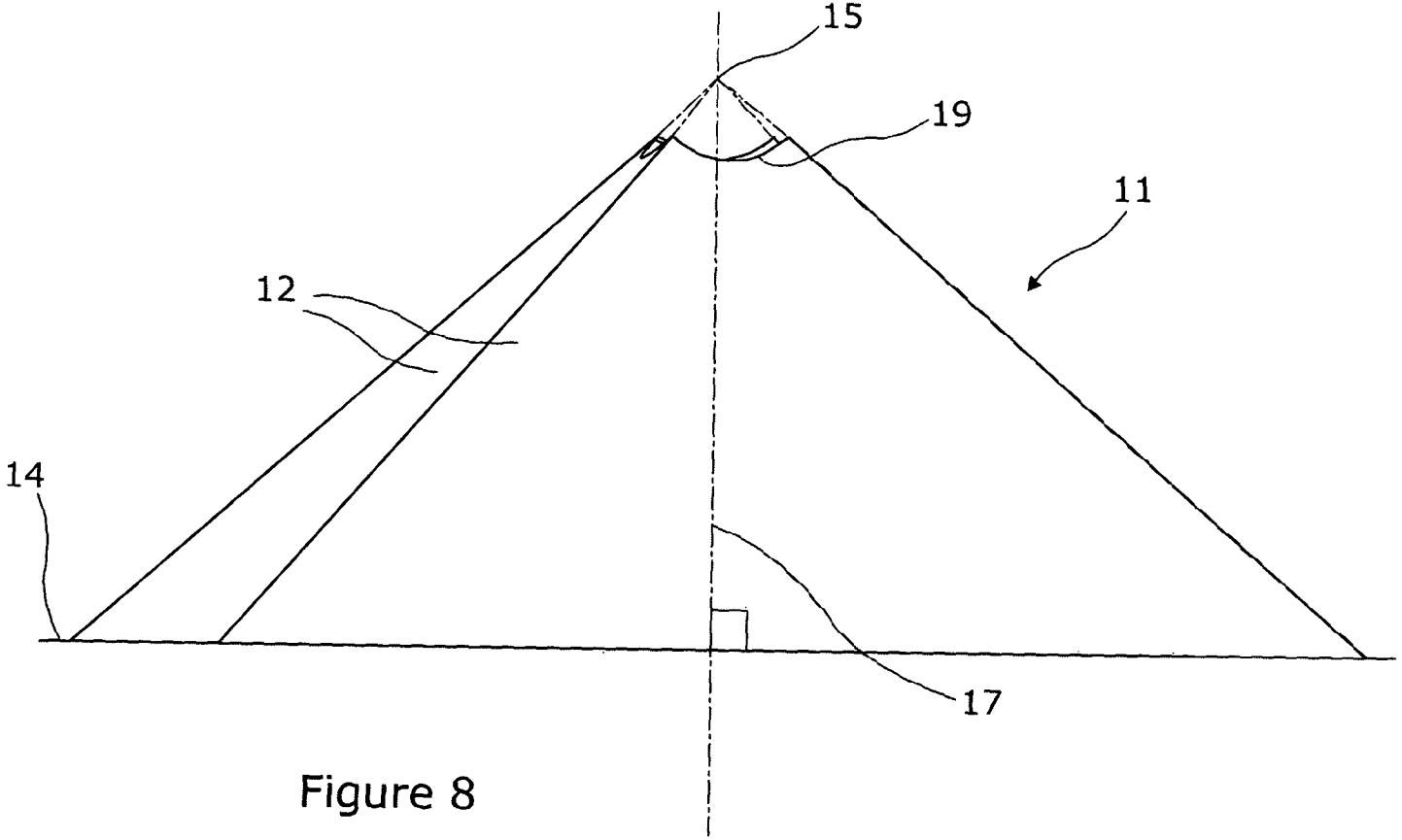

Referring to the drawings, there is shown an LER LUWPL luminaire 1 having a magnetron 2 heat conductingly mounted below a finned heat dissipater 3 with a suspension eye 4. The magnetron is attached to a microwave transition 5 having an antenna extending into a lucent fabrication 6, which is an LER lucent crucible and is surrounded by a Faraday cage 7. The arrangement results in the crucible projecting down from the heat dissipater, when the luminaire is suspended for use.

An imperforate cover 8 extends down from the heat dissipater. The cover is closed by a transparent screen 9, held to the cover by a moulding 10. The screen closes the luminaire against ingress of dust and/or moisture. The moulding supports a reflector 11 extending back to the lucent crucible, with its reflective surfaces obliquely facing both the crucible and the screen for reflection of light from the crucible out of the luminaire via the screen.

The reflector is of polished sheet metal. The moulding 10 is generally square shaped and the reflector comprises four triangular faces 12, pyramidally arranged, with a square base embodied by a rim 14 supported on the top of the screen 9 above the moulding 10. The faces converge to a virtual apex 15, on the central axis 16 of the lucent crucible. This axis is coincident with the pyramid's normal axis 17 from the apex to the centre of the base.

Between the circular heat dissipater 3 and the generally square transparent screen 9 and moulding 10, the shape of the cover 8 tapers outwardly and downwardly, merging from circular to square.

The faces 12 are angled at 45° to the base. In our currently proposed luminaire, the base is 500 mm square and the apex is 250 mm above the base.

The apex is virtual in that the crucible and its backing piece 18 project through an aperture 19 in the reflector, above which the apex would exist if the aperture were not there. The base of the lucent crucible is 57.5 mm below the apex. The crucible being 20 mm deep with its void 20 extending from a top cap 21 to a bottom cap 22. The void is centred 47.5 mm from the apex that is 47.5/250×100=19% or approximately 20% from the apex to the base.

Figure 9:
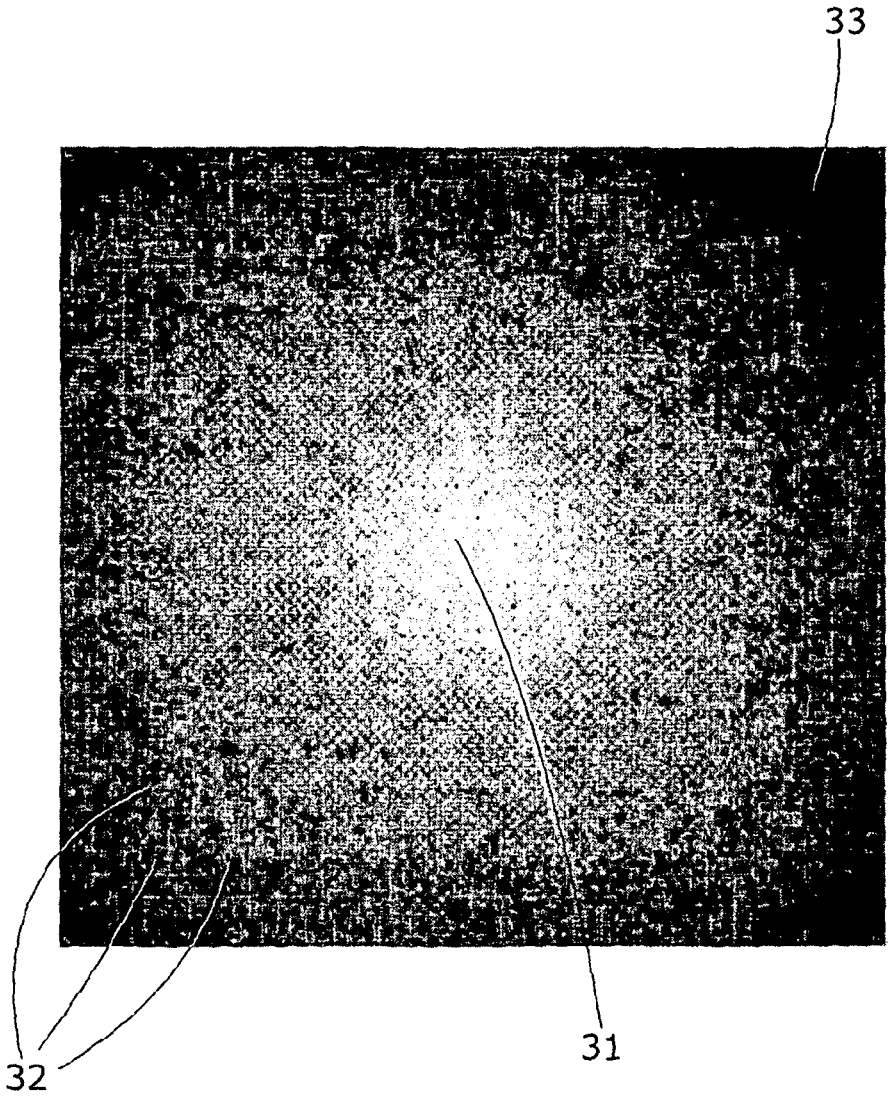
FIG. 9 is an irradiance plot showing distribution of light density in a beam projected from the luminaire of FIG. 1.

This arrangement produces the irradiance shown in FIG. 9. This can be seen to have a bright central patch 31, with a square shaped outer region 32. A slight darkening 33 can be noted in the top right hand corner, compared with the other corners. This is caused be the position of the antenna 23. This is arranged in a corresponding corner 24 of the reflector. By this is meant that the plane 25 common to both the centre of the void and the centre of the antenna is coincident with a diagonal plane of the reflector.

An LER LUWPL source luminaire (1) having a magnetron (2) heat conductingly mounted below a finned heat dissipater (3) with a suspension eye (4). The magnetron is attached to a microwave transition (5) and a lucent crucible (6). An imperforate cover (8) extends down from the heat dissipater and is closed by a transparent screen (9), held to the cover by a moulding (10). The moulding supports a polished-sheet-metal reflector (11) extending back to the lucent crucible, with its reflective surfaces obliquely facing both the crucible and the screen for reflection of light from the crucible out of the luminaire via the screen. The moulding (10) is generally square shaped and the reflector comprises four triangular faces (12), pyramidally arranged, with a square base embodied by a rim (14) supported on the top of the screen (9) above the moulding (10). The faces converge to a virtual apex (15), on the central axis (16) of the lucent crucible. This axis is coincident with the pyramid's normal axis (17) from the apex to the centre of the base. The faces (12) are angled at 45° to the base. The apex is virtual in that the crucible and its backing piece (18) project through an aperture 19 in the reflector, above which the apex would exist if the aperture were not there. This represents an improvement with respect to our First Luminaire, where the antenna casts a perceptible shadow.

The invention claimed is:

1. A Lucent Waveguide Plasma Light source luminaire comprising:

a light outlet, a LUWPL source and a reflector comprised of reflective surfaces obliquely facing both a fabrication of the LUWPL source and the light outlet from the luminaire, the reflective surfaces being arranged in the manner of a single frustum pyramid, with a closed void of the fabrication being at least substantially aligned with or intercepting the central axis of the single frustum pyramid, and the closed void of the LUWPL source being positioned at between 10% and 40% of the distance from an apex of the single frustum pyramid to its base.

2. A LUWPL source luminaire according to claim 1, wherein the closed void is positioned at between 15% and 30% of the distance from the apex of the single frustum pyramid to its base.

3. A LUWPL source luminaire according to claim 2, wherein the closed void is positioned at approximately 20% of the distance from the apex of the single frustum pyramid to its base.

4. A LUWPL source luminaire according to claim 3, wherein the reflective surfaces are arranged at between 40° and 50° to the central axis.

5. A LUWPL source luminaire according to claim 4, wherein the reflective surfaces are arranged at substantially 45° to the central axis.

6. A LUWPL source luminaire according to claim 1, wherein the reflective surfaces are curved.

7. A LUWPL source luminaire according to claim 6, wherein the reflective surfaces splay out with a greater angle to the axis further from the apex.

8. A LUWPL source luminaire according to claim 1, wherein the reflective surfaces are planar.

9. A LUWPL source luminaire according to claim 1, wherein the LUWPL is an LER LUPWL with an antenna arranged at least substantially in a bisector plane of the two faces of the single frustum pyramid arrangement.

10. A LUWPL source luminaire according to claim 1, wherein the single frustum pyramid has a square base.

11. A LUWPL source luminaire according to claim 1, wherein the single frustum pyramid has a rectangular base.

12. A LUWPL source luminaire according to claim 1, wherein the single frustum pyramid has three or five or more reflective surfaces, with the base of the single frustum pyramid having a corresponding number of sides.

13. A LUWPL source luminaire according to claim 1, wherein the LUWPL is an LER LUPWL having a magnetron heat conductingly mounted below a finned heat dissipater.

14. A LUWPL source luminaire according to claim 13, including a cover extending from the heat dissipater closed by a transparent screen, the reflective surfaces being supported within the cover above the transparent screen.

* * * * *